US006640595B2

(12) United States Patent
Sundgren et al.

(10) Patent No.: US 6,640,595 B2
(45) Date of Patent: Nov. 4, 2003

(54) APPARATUS FOR FORMING A THREE-DIMENSIONAL OBJECT

(75) Inventors: Anders Sundgren, Sunderbyn (SE); Mats Lindberg, Luleå (SE); Göran Berglund, Gammelstad (SE)

(73) Assignee: Accra Teknik AB, Ojebyn (SE)

( * ) Notice: Subject to any disclaimer, the term of this patent is extended or adjusted under 35 U.S.C. 154(b) by 17 days.

(21) Appl. No.: 09/897,770

(22) Filed: Jul. 2, 2001

(65) Prior Publication Data

US 2003/0000273 A1 Jan. 2, 2003

(51) Int. Cl.[7] ..... B21D 11/14

(52) U.S. Cl. ..... 72/14.8; 72/295; 72/298; 72/305

(58) Field of Search ..... 72/299, 298, 305, 72/420, 14.8, 295

(56) References Cited

U.S. PATENT DOCUMENTS

| | | | | | |
|---|---|---|---|---|---|
| 1,105,188 | A | * | 7/1914 | Dodge | 72/299 |
| 1,991,567 | A | * | 2/1935 | Morgan | 72/299 |
| 2,229,517 | A | * | 1/1941 | Nighthart | 72/299 |
| 2,297,055 | A | * | 9/1942 | Grad | 72/299 |
| 2,414,549 | A | * | 1/1947 | Nowak | 72/299 |
| 2,535,295 | A | | 12/1950 | Lafont | |
| 3,182,480 | A | * | 5/1965 | Menichi | 72/299 |
| 3,280,607 | A | * | 10/1966 | Esken | 72/299 |
| 3,400,567 | A | * | 9/1968 | Sirantoine | 72/299 |
| 3,628,369 | A | * | 12/1971 | Williamson | 72/385 |
| 3,678,723 | A | * | 7/1972 | Tenpas | 72/299 |
| 4,580,430 | A | * | 4/1986 | Takeda et al. | 72/299 |
| 4,972,696 | A | * | 11/1990 | Apps et al. | 72/299 |
| 5,022,129 | A | * | 6/1991 | Gentry | 72/404 |
| 6,185,978 | B1 | | 2/2001 | Sundgren et al. | |

* cited by examiner

*Primary Examiner*—Daniel C. Crane
(74) *Attorney, Agent, or Firm*—Ware, Fressola, Van der Sluys & Adophson LLP

(57) ABSTRACT

In a method and apparatus (1,31) for forming a three-dimensional object and in particular to a method and apparatus (1,31) for forming a three-dimensional beam, it is desirable to form three-dimensional beams (5) having complex forms by using an efficient forming process for the beams which may be incorporated into existing high volume production techniques. The apparatus (1,31) for forming three-dimensional beams (5) comprises a support device and an actuation device. Support members (2, 32, 41, 51, 61) spaced about the longitudinal axis of the support device locally define an opening (4, 35, 43, 53, 63) for supporting a section of the beam (5). The position of adjacent openings (4, 35, 43, 53, 63) relative to one another defines the overall form of the beam (5) and the actuation device defines the position of each opening (4, 35, 43, 53, 63).

21 Claims, 3 Drawing Sheets

APPARATUS FOR FORMING A THREE-DIMENSIONAL OBJECT

The present invention relates to a method and apparatus for forming a three-dimensional object and in particular to a method and apparatus for forming a beam.

Beams are increasingly used as support structures for the coachwork or body structure of automobiles and for use as support members for front and rear bumpers. The inventors of the present invention have disclosed a method and apparatus for curving three-dimensional closed profile beams in a plane parallel to the plane of movement of a forming tool in granted U.S. Pat. No. 6,185,978 B1. As automobile design is continuously evolving, new shapes and forms are required for the beams which provide the support structure for the body of the automobile. Therefore, it is now desirable to form beams having a large variety of shapes and forms over and above beams curved in one plane as disclosed in the prior art. However, it is also desirable to retain the efficiency associated with manufacturing processes which may be incorporated into high volume production techniques.

It is an object of the present invention to provide an apparatus and method for the forming of three-dimensional objects and in particular beams which are required to have complex forms by using an efficient forming process for the beams which may be incorporated into existing high volume production techniques.

Accordingly, the present invention provides an apparatus for forming three-dimensional objects and in particular three-dimensional beams comprising a support means and an actuation means characterised in that the support means has a number of support members spaced about the longitudinal axis of the support means where each individual support member locally defines an opening for supporting a section of the beam and the position of adjacent openings relative to one another defines the overall form of the beam wherein the actuation means defines the position of each opening.

Preferably, the openings define a position and a shape for a section of a beam within a plane substantially perpendicular to the longitudinal axis of the support means.

Ideally, the support members are also movable in a direction parallel to the longitudinal axis of the support means.

Preferably, the support members are independently operable.

Ideally, each support member is provided as a separable tool having two corresponding halves.

Preferably, each half of the tool is provided with its own actuation means.

Ideally, the actuation means includes physical ramps leading into the openings defined by the support members.

Ideally, the actuation means includes at least one axially adjustable shaft.

Preferably, the shaft is telescopic.

In one embodiment, the actuation means provides support frames for receiving the shafts.

Preferably, the support frames define channels which extend longitudinally on at least two opposite side members of each support frame.

Ideally, the shafts are movably mounted about the channels.

Preferably, the support frames are substantially rectangular.

Additionally, the actuation means provides housings for receiving the support frames.

Preferably, the housings are cylindrical.

Ideally, the support frames are rotatably mounted about the cylindrical housings.

Ideally, the actuation means is operated by mechanical, electrical, pneumatic or manual means.

Preferably, the actuation means is remotely operable.

Ideally, the support members are formed for receiving beams having a variety of cross-sectional shapes.

Preferably, the support members are formed for receiving cylindrical and non cylindrical beams.

Ideally, the apparatus includes a quenching means.

Preferably, the quenching means is provided by a water dispenser mounted on or about the apparatus.

Optionally, the entire apparatus may be enclosed in a chamber and gas is dispensed into the chamber to quench the newly formed beam.

Ideally, the apparatus comprises a mounting means for mounting the apparatus on a production facility.

Preferably, the actuation means is remotely operable in response to a control programme running on a control unit.

Ideally, the control programme contains information regarding the relative location of a beam and each support member and the desired form of the beam at each point of contact with each support member.

The present invention also provides a method of forming three-dimensional beams characterised in that sections of the beam are formed locally by support members and adjacent support members are positioned relative to one another to define the overall form of the beam.

In one method, the beam is first engaged by the support members and then formed into a desired overall form by adjustment of the individual support members by the actuation means.

In another method, sections of the beam are first biased by ramps into openings located relative to one another and then formed locally by the openings in the support members.

Preferably, the corresponding halves of the tool on either side of the beam are moved towards one another by the actuation means and the beam is biased into the openings by the interaction of corresponding ramps as a result of the movement of the tool halves towards each other.

Preferably, the beam is pre-formed by any suitable manufacturing process and is preheated to a predetermined temperature for forming.

Ideally, suitable manufacturing processes include roll forming and blow moulding.

Preferably, the forming is carried out at one workstation.

Optionally, when the beam is non-cylindrical, the method of forming the beam includes twisting of the beam about its longitudinal axis.

Ideally, the method of forming the beam includes quenching of the beam after forming has taken place.

The present invention will now be described with reference to the accompanying drawings which show by way of example only, two embodiments of an apparatus for forming three-dimensional beams in accordance with the invention. In the drawings;

FIG. 1 is a perspective view of a first embodiment of an apparatus for forming three-dimensional beams;

FIG. 2 is a perspective view of a beam formed by the apparatus of FIG. 1.

FIG. 3 is a perspective view of a second embodiment of an apparatus in accordance with the invention;

FIG. 4 is a perspective view of a second embodiment of support member;

FIG. 5 is a perspective view of a third embodiment of support member; and

FIG. 6 is a perspective view of a fourth embodiment of support member.

Referring to the drawings and initially to FIG. 1, there is shown an apparatus indicated generally by the reference numeral 1. Support members 2 have two corresponding separable tool halves 3 which define openings 4 to support a beam 5. In this specific embodiment the tool halves 3 and the beam 5 are substantially rectangular. Bach of the tool halves 3 has an axially adjustable shaft 6. The shafts 6 are mounted on rectangular frames 7 and are movable along channels 9 which extend longitudinally about opposite side members of the frames 7. The frames 7 are rotatably mounted in cylindrical housings 8. A dispenser (not shown) for flushing the beam 5 with cooling liquid may also be mounted on the apparatus 1. Referring to FIG. 2 there is shown the beam 5 of FIG. 1 after forming has taken place. The beam 5 has been twisted about its longitudinal axis as a result of rotation of one or more of the rectangular frames 7 in one or more of the cylindrical housings 8.

In use, a preheated beam 5 is passed to the apparatus 1 between the tool halves 3 from a conveyer or any standard delivery mechanism used in conjunction with production lines. The beam 5 is then clamped between the halves 3 which are suitably spaced about the longitudinal axis of the apparatus 1 to support the beam 5. The shafts 6 are slidably movable along channels 9 which extend longitudinally on at least two opposite side members of each rectangular frame 7. Axial adjustment of the shafts 6 in combination with slidable movement of the shafts 6 along the channels 9 allows movement for the shafts 6, tool halves 3 and the beam 5 within a plane defined by each rectangular frame 7 and substantially perpendicular to the longitudinal axis of the apparatus 1. The rectangular frames 7 are rotatably mounted in cylindrical housings 8 and the frames 7 may be locked in position in the housing 8 or may be rotated in response to manual, electrical, pneumatic or hydraulic actuation. The rotation of the frames 7 applies a torque to the beam 5 about its longitudinal axis. The cylindrical housings 8 may be fixed in a desired position or may be adjusted in a direction parallel to the longitudinal axis of the apparatus 1.

In FIG. 3, a second embodiment of an apparatus for forming three-dimensional beams is indicated generally by the reference numeral 31. Support members 32 are provided as separable tool halves 33, where one half 33 of each support member 32 is shown in the drawing. Each tool half 33 is provided with a ramp 34 which biases the beam 5 into an opening 35 defined by the corresponding halves 33 of the support members 32. The physical dimensions of the ramps 34 and their geometrical positions define the relative position of adjacent openings 35. Each half 33 of each support member 32 has an actuator provided in this particular embodiment by an axially adjustable shaft 36. It will of course be appreciated that the tool halves 33 may be mounted on rollers and/or located in channels to provide direction for their motion. It will also be appreciated that the actuators may be mechanical, electrical, pneumatic, hydraulic or manual or any combination of these actuators. In addition to ramps 34 of different dimensions it is also possible to use a standard size ramp. The ramp may be raised or lowered through channels in a base (not shown) of the apparatus 31 in order to alter the vertical distance the openings 35 are located above the base.

In use, a beam 5 is passed between separable tool halves 33 to a predetermined position. The halves 33 are actuated by shafts 36 towards their corresponding halves 33 on the other side of the beam 5. The ramps 34 first engage the underside of the beam 5 and bias said beam 5 upwards towards the openings 35 defined by the support members 32. Corresponding ramps 34 are designed to pass side by side or may be formed one to receive the other.

Referring to the drawings and now to FIG. 4 there is shown a second embodiment of support member indicated generally by the reference numeral 41 for use with the actuation means of FIG. 1 or FIG. 2. The support members 41 provide a pair of separable tool halves 42 which define openings 43. In this embodiment, the openings 43 defined by the tool halves 42 are cylindrical. Each opening 43 supports a section of the beam 5. In this embodiment, the three central support members 41 are mounted on one connecting plate 44. Each separate tool half 42 and the connecting plate 44 is mounted on a corresponding shaft (not shown) which provides movement for the tool halves 42 and the beam 5. This embodiment is particularly useful where a large volume of a beam with a standard shape is required. Referring to FIG. 5, there is shown another embodiment of support member indicated generally by the reference numeral 51 for use with the actuation means of FIG. 1 or FIG. 2. In this embodiment the cylindrical beam 5 and the tool halves 52 defining cylindrical openings 53 are formed for independent adjustment by corresponding shafts. Referring to the drawings and finally to FIG. 6 there is shown another embodiment of support member indicated generally by the reference numeral 61 where the separable tool halves 62 define openings 63 which locally form the cross-sectional shape of the beam 5.

It will of course be understood that the invention is not limited to the specific details as herein described, which are given by way of example only, and that various alterations and modifications may be made without departing from the scope of the invention as defined in the appended claims.

What is claimed is:

1. An apparatus for three-dimensional forming of a beam, the apparatus comprising:

(a) support means having a number of support members spaced about a longitudinal axis of the support means, each individual support member locally defines an opening for supporting a section of the beam and is provided as a separable tool having two corresponding halves; and (b) actuation means provided for each half of each tool so each half can move independently in relation to each other thereby defining the position of each opening whereby the positions of adjacent openings relative to one another defines the overall form of the beam, the actuation means includes at least one axially adjustable shaft and provides support frames for receiving the at least one axially adjustable shaft, the support frames define channels which extend longitudinally on at least two opposite side members of each support frame and the at least one axial adjustable shaft is movably mounted about the channels.

2. An apparatus as claimed in claim 1, wherein each of the openings defines a position and a shape for a section of the beam within a plane substantially perpendicular to the longitudinal axis of the support means.

3. An apparatus as claimed in claim 2, wherein the support members are movable in a direction parallel to the longitudinal axis of the support means.

4. An apparatus as claimed in claim 3, wherein the support members are independently operable.

5. An apparatus as claimed in claim 1, wherein the support members are movable in a direction parallel to the longitudinal axis of the support means.

6. An apparatus as claimed in claim 5, wherein the support members are independently operable.

7. An apparatus as claimed in claim 1, wherein the support members are independently operable.

8. An apparatus as claimed in claim 1, wherein the support frames are substantially rectangular.

9. An apparatus as claimed in claim 8, wherein the actuation means provides housings for receiving the support frames.

10. An apparatus as claimed in claim 9, wherein the housings are cylindrical.

11. An apparatus as claimed in claim 10, wherein the support frames are rotatably mounted about the cylindrical housings.

12. An apparatus as claimed in claim 1, wherein the actuation means is actuated by means chosen from a group consisting of mechanical, electrical, pneumatic and manual means.

13. An apparatus as claimed in claim 12, wherein the actuation means is remotely operable.

14. An apparatus as claimed in claim 1, wherein the actuation means is remotely operable.

15. An apparatus as claimed in claim 1, wherein the openings defined by the support members are formed for receiving beams having a cross-sectional shape chosen from a group consisting of cylindrical and non-cylindrical shapes.

16. An apparatus as claimed in claim 1, wherein the apparatus further includes quenching means.

17. An apparatus as claimed in claim 16, wherein the quenching means is provided by a water dispenser.

18. An apparatus as claimed in claim 16, wherein the quenching means is a chamber enclosing at least the beam and means for dispensing gas into the chamber to quench the beam.

19. An apparatus as claimed in claim 1, further comprising mounting means for mounting the apparatus on a production facility.

20. An apparatus as claimed in claim 1, wherein the actuation means is remotely operable in response to a control program running on a control unit.

21. An apparatus as claimed in claim 20, wherein the control program contains information regarding relative locations of the beam and each support member and a desired form of the beam at each point of contact with each support member.

* * * * *

UNITED STATES PATENT AND TRADEMARK OFFICE

CERTIFICATE OF CORRECTION

PATENT NO. : 6,640,595 B2
APPLICATION NO. : 09/897770
DATED : November 4, 2003
INVENTOR(S) : Anders Sundgren et al.

It is certified that error appears in the above-identified patent and that said Letters Patent is hereby corrected as shown below:

The title page and specification should be deleted and replaced with the attached title page and specification.

Delete drawing sheets 1-3 and replace with the attached drawing sheets.

Signed and Sealed this

Twentieth Day of June, 2006

JON W. DUDAS
*Director of the United States Patent and Trademark Office*

(12) United States Patent
Sundgren et al.

(10) Patent No.: US 6,640,595 B2
(45) Date of Patent: Nov. 4, 2003

(54) APPARATUS FOR FORMING A THREE-DIMENSIONAL OBJECT

(75) Inventors: Anders Sundgren, Sunderbyn (SE); Mats Lindberg, Luleå (SE); Göran Berglund, Gammelstad (SE)

(73) Assignee: Accra Teknik AB, Ojebyn (SE)

( * ) Notice: Subject to any disclaimer, the term of this patent is extended or adjusted under 35 U.S.C. 154(b) by 17 days.

(21) Appl. No.: 09/897,770

(22) Filed: Jul. 2, 2001

(65) Prior Publication Data

US 2003/0000273 A1 Jan. 2, 2003

(51) Int. Cl.[7] ..... B21D 11/14

(52) U.S. Cl. ..... 72/14.8; 72/295; 72/298; 72/305

(58) Field of Search ..... 72/299, 298, 305, 72/420, 14.8, 295

(56) References Cited

U.S. PATENT DOCUMENTS

| | | | | | |
|---|---|---|---|---|---|
| 1,105,188 | A | * | 7/1914 | Dodge | 72/299 |
| 1,991,567 | A | * | 2/1935 | Morgan | 72/299 |
| 2,229,517 | A | * | 1/1941 | Nighthart | 72/299 |
| 2,297,055 | A | * | 9/1942 | Grad | 72/299 |
| 2,414,549 | A | * | 1/1947 | Nowak | 72/299 |
| 2,535,295 | A | | 12/1950 | Lafont | |
| 3,182,480 | A | * | 5/1965 | Menichi | 72/299 |
| 3,280,607 | A | * | 10/1966 | Esken | 72/299 |
| 3,400,567 | A | * | 9/1968 | Sirantoine | 72/299 |
| 3,628,369 | A | * | 12/1971 | Williamson | 72/385 |
| 3,678,723 | A | * | 7/1972 | Tenpas | 72/299 |
| 4,580,430 | A | * | 4/1986 | Takeda et al. | 72/299 |
| 4,972,696 | A | * | 11/1990 | Apps et al. | 72/299 |
| 5,022,129 | A | * | 6/1991 | Gentry | 72/404 |
| 6,185,978 | B1 | | 2/2001 | Sundgren et al. | |

* cited by examiner

*Primary Examiner*—Daniel C. Crane
(74) *Attorney, Agent, or Firm*—Ware, Fressola, Van der Sluys & Adolphson LLP

(57) ABSTRACT

In a method and apparatus (1,31) for forming a three-dimensional object and in particular to a method and apparatus (1,31) for forming a three-dimensional beam, it is desirable to form three-dimensional beams (5) having complex forms by using an efficient forming process for the beams which may be incorporated into existing high volume production techniques. The apparatus (1,31) for forming three-dimensional beams (5) comprises a support device and an actuation device. Support members (2, 32, 41, 51, 61) spaced about the longitudinal axis of the support device locally define an opening (4, 35, 43, 53, 63) for supporting a section of the beam (5). The position of adjacent openings (4, 35, 43, 53, 63) relative to one another defines the overall form of the beam (5) and the actuation device defines the position of each opening (4, 35, 43, 53, 63).

21 Claims, 3 Drawing Sheets

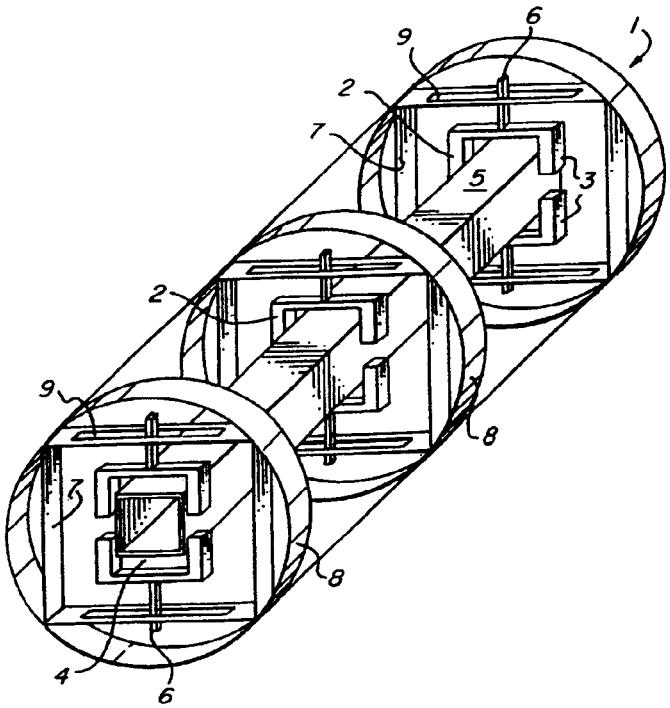

APPARATUS FOR FORMING A THREE-DIMENSIONAL OBJECT

BACKGROUND OF THE INVENTION

1. Technical Field

The present invention relates to a method and apparatus for forming a three-dimensional object and in particular to a method and apparatus for forming a beam.

2. Description of the Background Art

Beams are increasingly used as support structures for the coachwork or body structure of automobiles and for use as support members for front and rear bumpers. The inventors of the present invention have disclosed a method and apparatus for curving three-dimensional closed profile beams in a plane parallel to the plane of movement of a forming tool in granted U.S. Pat. No. 6,185,978. As automobile design is continuously evolving, new shapes and forms are required for the beams which provide the support structure for the body of the automobile. Therefore, it is now desirable to form beams having a large variety of shapes and forms over and above beams curved in one plane as disclosed in the prior art. However, it is also desirable to retain the efficiency associated with manufacturing processes which may be incorporated into high volume production techniques.

SUMMARY OF THE INVENTION

Accordingly, the present invention provides an apparatus for forming three-dimensional objects in particular three-dimensional beams comprising a support means and an actuation means characterized in that the support means has a number of support members spaced about the longitudinal axis of the support means where each individual support member locally defines an opening for supporting a section of the beam and the position of adjacent openings relative to one another defines the overall form of the beam wherein the actuation means defines the position of each opening.

Preferably, the openings define a position and a shape for a section of a beam within a plane substantially perpendicular to the longitudinal axis of the support means.

Ideally, the support members are also movable in a direction parallel to the longitudinal axis of the support means.

Preferably, the support members are independently operable.

Ideally, each support member is provided as a separable tool having two corresponding halves.

Preferably, each half of the tool is provided with its own actuation means.

Ideally, the actuation means includes physical ramps leading into the openings defined by the support members.

Ideally, the actuation means includes at least one axially adjustable shaft.

Preferably, the shaft is telescopic.

In one embodiment, the actuation means provides support frames for receiving the shafts.

Preferably, the support frames define channels which extend longitudinally on at least two opposite side members of each support frame.

Ideally, the shafts are movably mounted about the channels.

Preferably, the support frames are substantially rectangular.

Additionally, the actuation means provides housings for receiving the support frames.

Preferably, the housings are cylindrical.

Ideally, the support frames are rotatably mounted about the cylindrical housings.

Ideally, the actuation means is operated by mechanical, electrical, pneumatic or manual means.

Preferably, the actuation means is remotely operable.

Ideally, the support members are formed for receiving beams having a variety of cross-sectional shapes.

Preferably, the support members are formed for receiving cylindrical and non cylindrical beams.

Ideally, the apparatus includes a quenching means.

Preferably, the quenching means is provided by a water dispenser mounted on or about the apparatus.

Optionally, the entire apparatus may be enclosed in a chamber and gas is dispensed into the chamber to quench the newly formed beam.

Ideally, the apparatus comprises a mounting means for mounting the apparatus on a production facility.

Preferably, the actuation means is remotely operable in response to a control program running on a control unit.

Ideally, the control programme contains information regarding the relative location of a beam and each support member and the desired form of the beam at each point of contact with each support member.

The present invention also provides a method of forming three-dimensional beams characterised in that sections of the beam are formed locally by support members and adjacent support members are positioned relative to one another to define the overall form of the beam.

In one method, the beam is first engaged by the support members and then formed into a desired overall form by adjustment of the individual support members by the actuation means.

In another method, sections of the beam are first biased by ramps into openings located relative to one another and then formed locally by the openings in the support members.

Preferably, the corresponding halves of the tool on either side of the beam are moved towards one another by the actuation means and the beam is biased into the openings by the interaction of corresponding ramps as a result of the movement of the tool halves towards each other.

Preferably, the beam is pre-formed by any suitable manufacturing process and is preheated to a predetermined temperature for forming.

Ideally, suitable manufacturing processes include roll forming and blow moulding.

Preferably, the forming is carried out at one workstation.

Optionally, when the beam is non-cylindrical, the method of forming the beam includes twisting of the beam about its longitudinal axis.

Ideally, the method of forming the beam includes quenching of the beam after forming has taken place.

BRIEF DESCRIPTION OF THE DRAWINGS

The present invention will now be described with reference to the accompanying drawings which show by way of example only, two embodiments of an apparatus for forming three-dimensional beams in accordance with the invention. In the drawings.

DETAILED DESCRIPTION OF THE INVENTION

Figure 1:
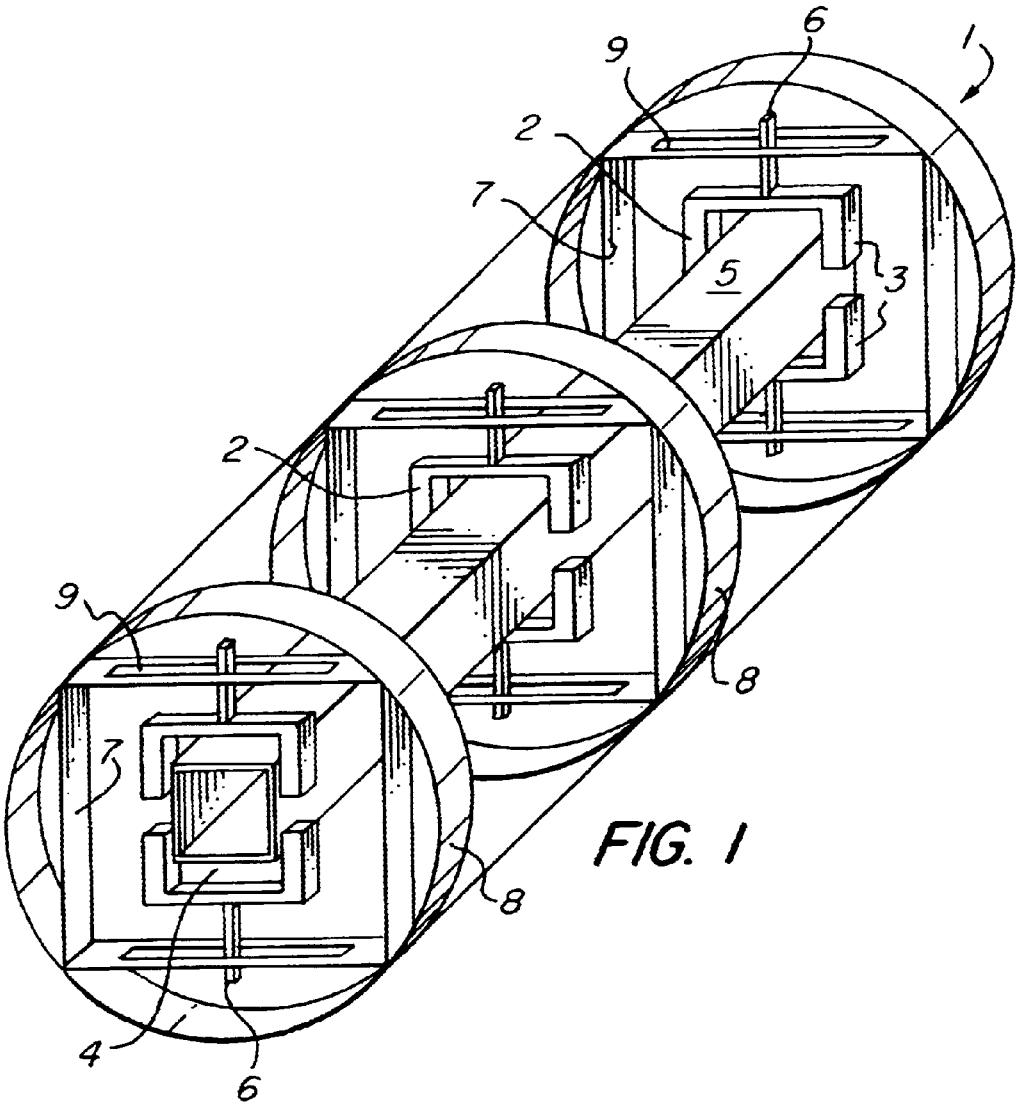
FIG. 1 is a perspective view of a first embodiment of an apparatus for forming three-dimensional beams.
Figure 2:
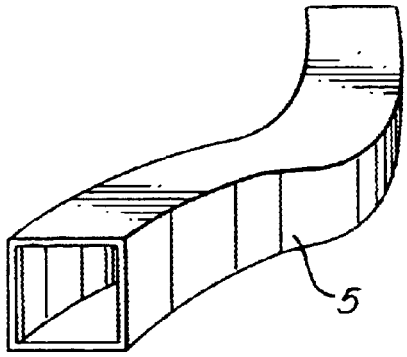
FIG. 2 is a perspective view of a beam formed by the apparatus of FIG. 1.

Referring to the drawings and initially to FIG. 1, there is shown an apparatus indicated generally by the reference numeral 1. Each support member 2 has two corresponding separable tool halves 3 which define openings 4 to support a beam 5. In this specific embodiment, the tool halves 3 and the beam 5 are substantially rectangular. Each of the tool halves 3 has an axially adjustable shaft 6. The shafts 6 are mounted on rectangular frames 7 and are movable along channels 9 which extend longitudinally about opposite side members of the frames 7. The frames 7 are rotatably mounted in cylindrical housings 8. A dispenser (not shown) for flushing the beam 5 with cooling liquid may also be mounted on the apparatus 1. Referring to FIG. 2 there is shown the beam 5 of FIG. 1 after forming has taken place. The beam 5 has been twisted about its longitudinal axis as a result of rotation of one or more of the rectangular frames 7 in one or more of the cylindrical housings 8.

In use, a preheated beam 5 is passed to the apparatus 1 between the tool halves 3 from a conveyor or any standard delivery mechanism used in conjunction with production lines. The beam 5 is then clamped between the halves 3 which are suitably spaced about the longitudinal axis of the apparatus 1 to support the beam 5. The shafts 6 are slidably movable along channels 9 which extend longitudinally on at least two opposite side members of each rectangular frame 7. Axial adjustment of the shafts 6 in combination with slidable movement of the shafts 6 along the channels 9 allows movement for the shafts 6, tool halves 3 and the beam 5 within a plane defined by each rectangular frame 7 and substantially perpendicular to the longitudinal axis of the apparatus 1. The rectangular frames 7 are rotatably mounted in cylindrical housings 8 and the frames 7 may be locked in position in the housing 8 or may be rotated in response to manual, electrical, pneumatic or hydraulic actuation. The rotation of the frames 7 applies a torque to the beam 5 about its longitudinal axis. The cylindrical housings 8 may be fixed in a desired position or may be adjusted in a direction parallel to the longitudinal axis of the apparatus 1.

Figure 3:
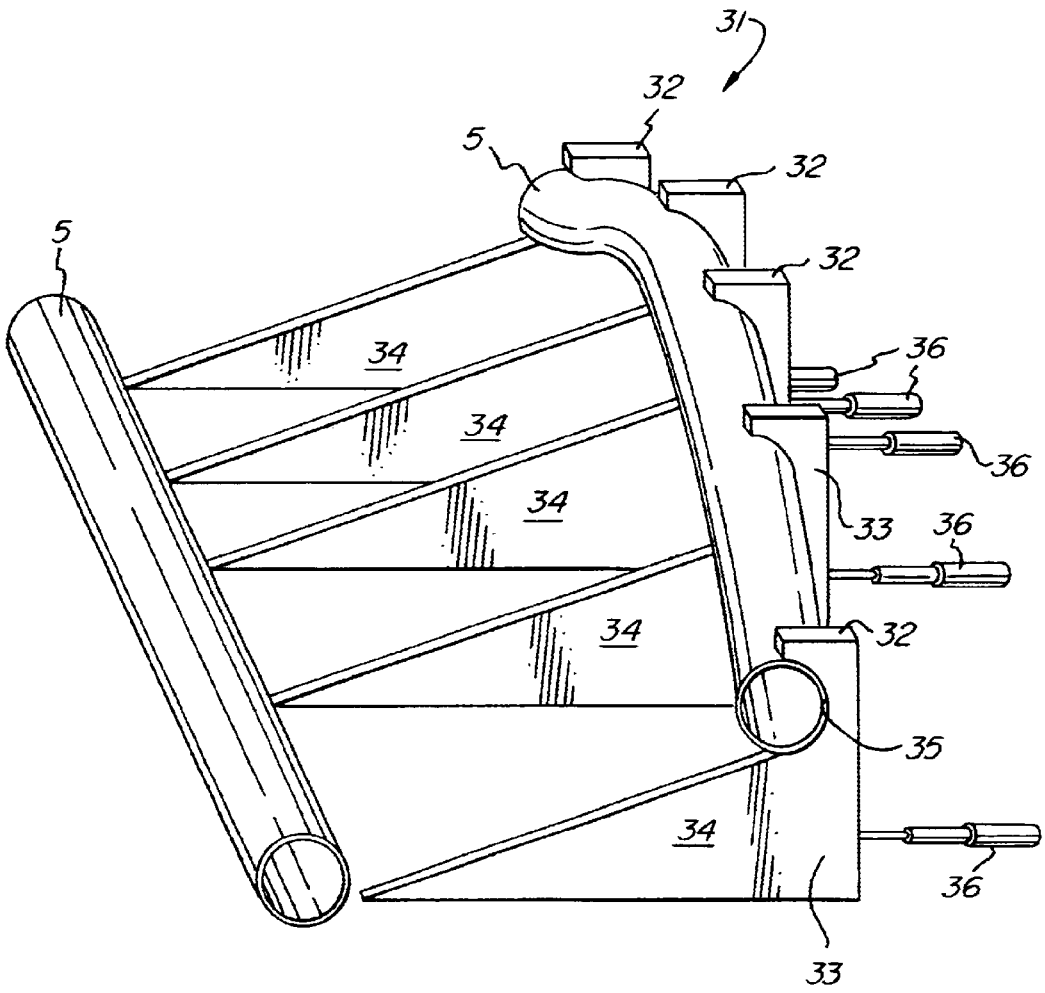
FIG. 3 is a perspective view of a second embodiment of an apparatus in accordance with the invention.

In FIG. 3, a second embodiment of an apparatus for forming three-dimensional beams is indicated generally by the reference numeral 31. Support members 32 are provided as separable tool halves 33, where one half 33 of each support member 32 is shown in the drawing. Each tool half 33 is provided with a ramp 34 which biases the beam 5 into an opening 35 defined by the corresponding halves 33 of the support members 32. The physical dimensions of the ramps 34 and their geometrical positions define the relative position of adjacent openings 35. Each half 33 of each support member 32 has an actuator provided in this particular embodiment by an axially adjustable shaft 36. It will of course be appreciated that the tool halves 33 may be mounted on rollers and/or located in channels to provide direction for their motion. It will also be appreciated that the actuators may be mechanical, electrical, pneumatic, hydraulic or manual or any combination of these actuators. In addition to ramps 34 of different dimensions it is also possible to use a standard size ramp. The ramp may be raised or lowered through channels in a base (not shown) of the apparatus 31 in order to alter the vertical distance the openings 35 are located above the base.

In use, a beam 5 is passed between separable tool halves 33 to a predetermined position. The halves 33 are actuated by shafts 36 towards their corresponding halves 33 on the other side of the beam 5. The ramps 34 first engage the underside of the beam 5 and bias said beam 5 upwards towards the openings 35 defined by the support members 32. Corresponding ramps 34 are designed to pass side by side or may be formed one to receive the other.

Figure 4:
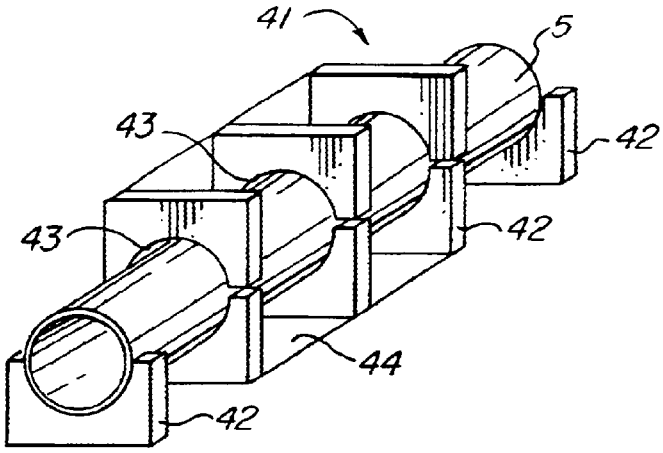
FIG. 4 is a perspective view of a second embodiment of support member.

Referring to the drawings and now to FIG. 4 there is shown a second embodiment of support member indicated generally by the reference numeral 41 for use with the actuation means of FIG. 1 or FIG. 2. Each support member 41 is provided by a pair of separable tool halves 42 which define an opening 43. In this embodiment, the three central support members 41 are mounted on one connecting plate 44. Each separate tool half 42 and the connecting plate 44 is mounted on a corresponding shaft (not shown) which provides movement for the tool halves 42 and the beam 5. This embodiment is particularly useful where a large volume of a beam with a standard shape is required.

Figure 5:
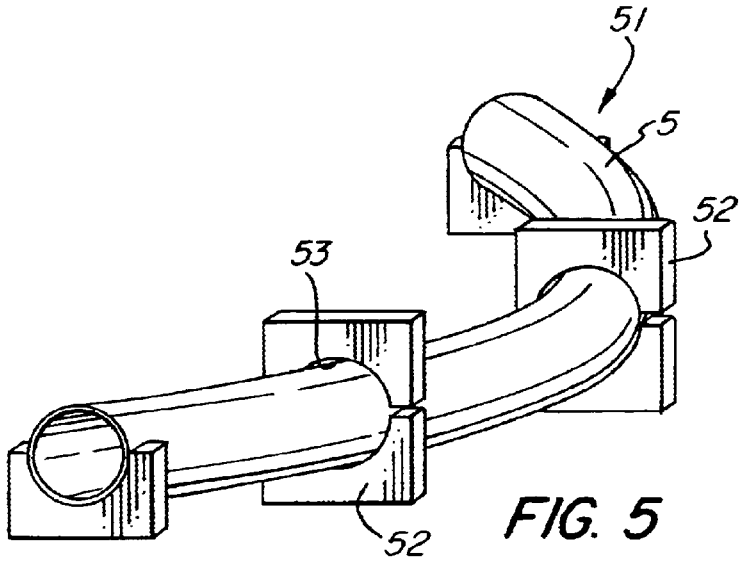
FIG. 5 is a perspective view of a third embodiment of support member.

Referring to FIG. 5, there is shown another embodiment of support member indicated generally by the reference numeral 51 for use with the actuation means of FIG. 1 or FIG. 2. In this embodiment, the cylindrical beam 5 and the tool halves 52 defining cylindrical openings 53 are formed for independent adjustment by corresponding shafts.

Figure 6:
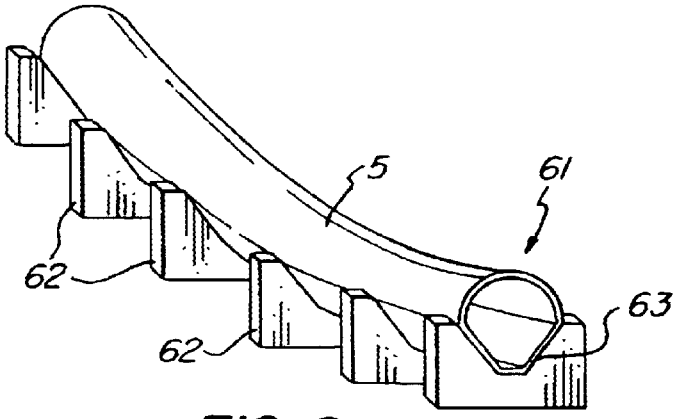
FIG. 6 is a perspective view of a fourth embodiment of support member.
Figure 1:
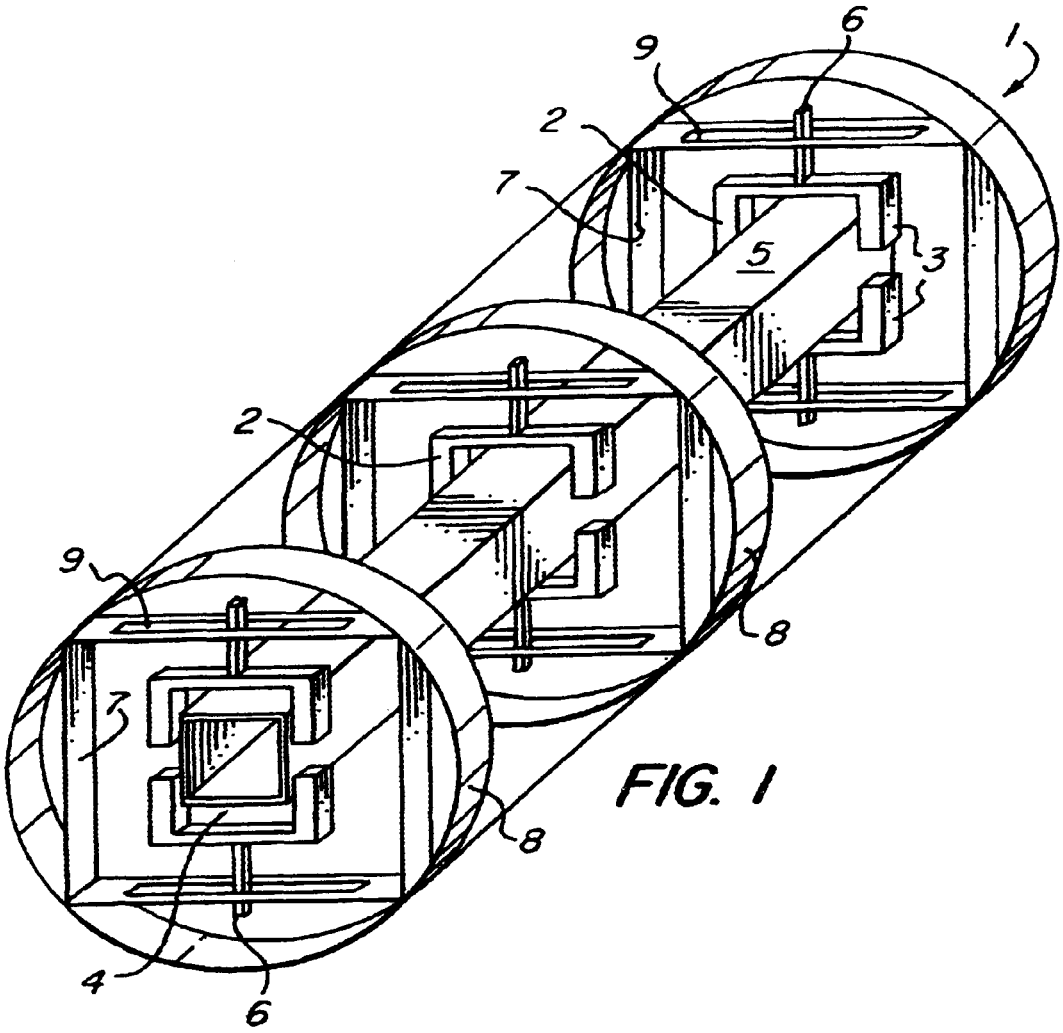
Figure 2:
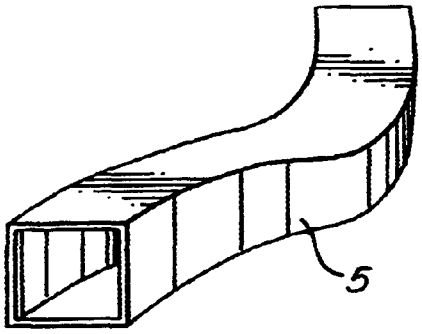
Figure 3:
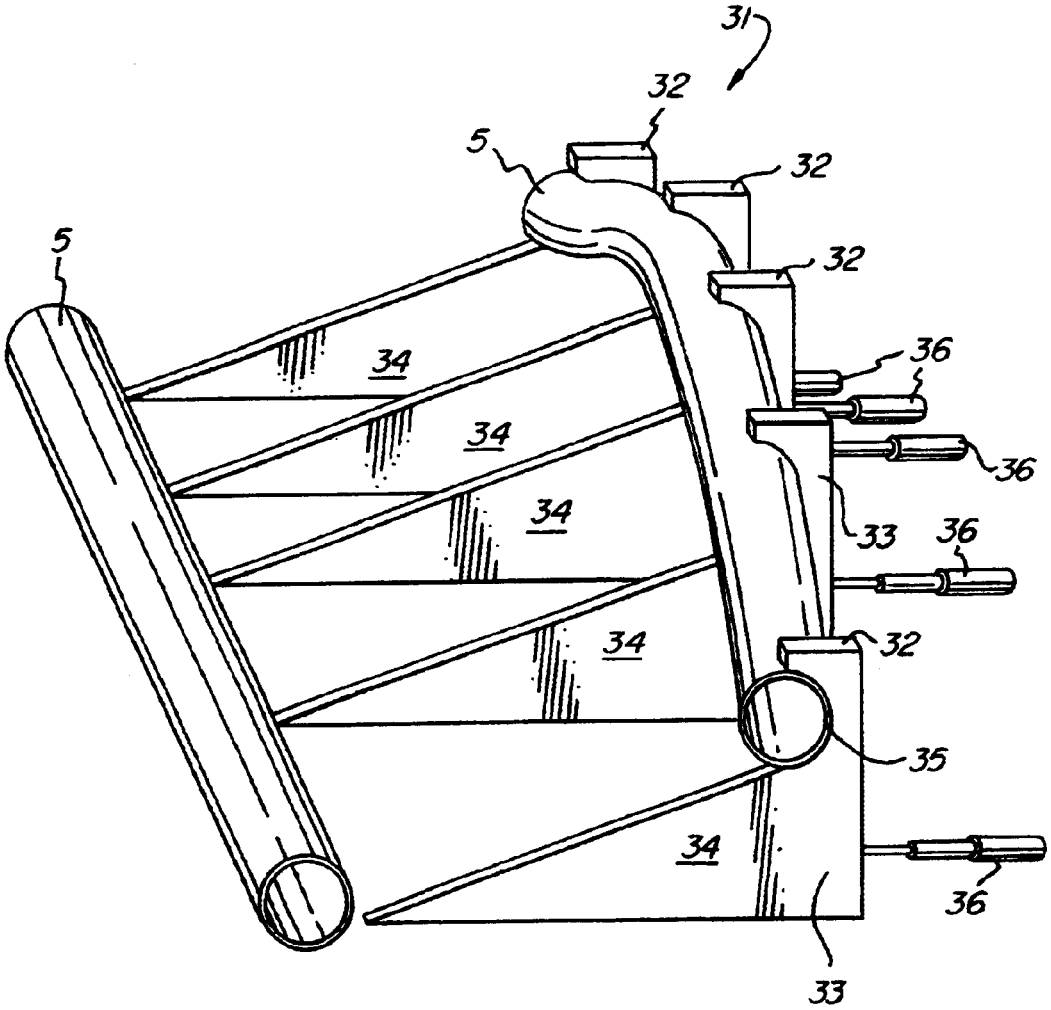
Figure 4:
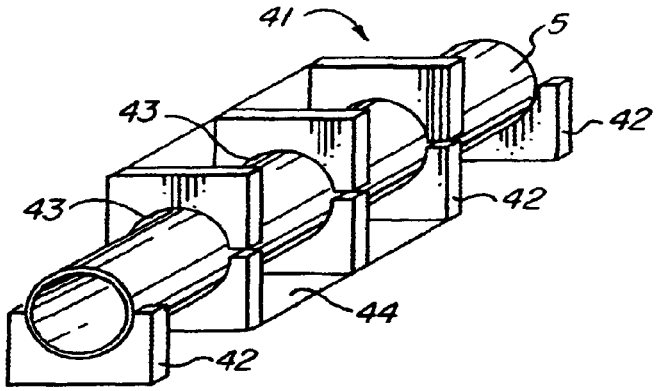
Figure 5:
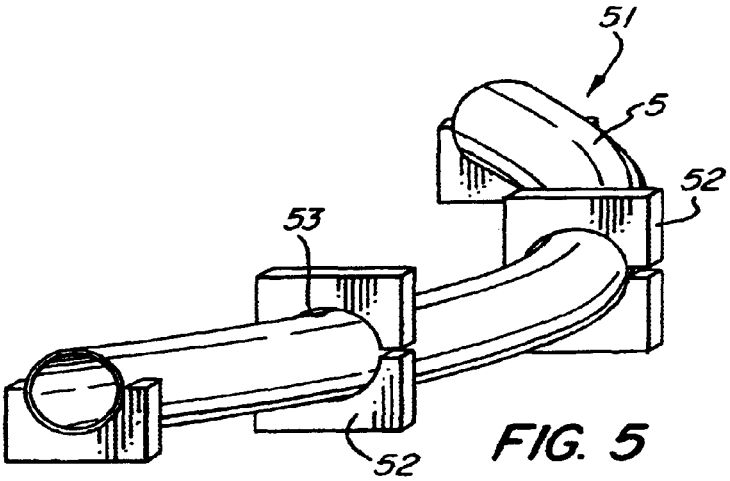
Figure 6:
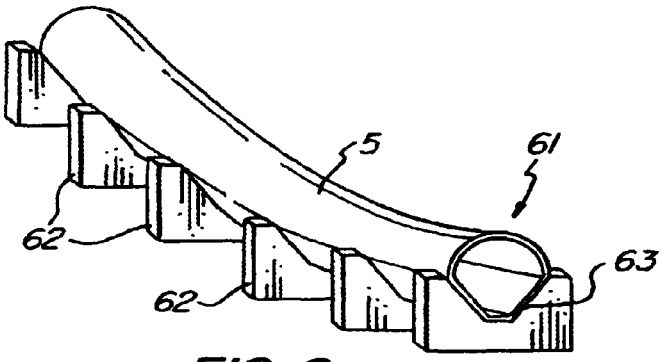

Referring to the drawings and finally to FIG. 6, there is shown another embodiment of support member indicated generally by reference numeral 61 where the separable tool halves 62 (only one half of each pair of halves shown) define openings 63 which locally form the cross-sectional shape of the beam 5.

It will of course be understood that the invention is not limited to the specific details as herein described, which are given by way of example only, and that various alterations and modifications may be made without departing from the scope of the invention as defined in the appended claims.

What is claimed is:

1. An apparatus for three-dimensional forming of a beam, the apparatus comprising:

(a) support means having a number of support members spaced about a longitudinal axis of the support means, each individual support member locally defines an opening for supporting a section of the beam and is provided as a separable tool having two corresponding halves; and (b) actuation means provided for each half of each tool so each half can move independently in relation to each other thereby defining the position of each opening whereby the positions of adjacent openings relative to one another defines the overall form of the beam, the actuation means includes at least one axially adjustable shaft and provides support frames for receiving the at least one axially adjustable shaft, the support frames define channels which extend longitudinally on at least two opposite side members of each support frame and the at least one axial adjustable shaft is movably mounted about the channels.

2. An apparatus as claimed in claim 1, wherein each of the openings defines a position and a shape for a section of the beam within a plane substantially perpendicular to the longitudinal axis of the support means.

3. An apparatus as claimed in claim 2, wherein the support members are movable in a direction parallel to the longitudinal axis of the support means.

4. An apparatus as claimed in claim 3, wherein the support members are independently operable.

5. An apparatus as claimed in claim 1, wherein the support members are movable in a direction parallel to the longitudinal axis of the support means.

6. An apparatus as claimed in claim 5, wherein the support members are independently operable.

7. An apparatus as claimed in claim 1, wherein the support members are independently operable.

8. An apparatus as claimed in claim 1, wherein the support frames are substantially rectangular.

9. An apparatus as claimed in claim 8, wherein the actuation means provides housings for receiving the support frames.

10. An apparatus as claimed in claim 9, wherein the housings are cylindrical.

11. An apparatus as claimed in claim 10, wherein the support frames are rotatably mounted about the cylindrical housings.

12. An apparatus as claimed in claim 1, wherein the actuation means is actuated by means chosen from a group consisting of mechanical, electrical, pneumatic and manual means.

13. An apparatus as claimed in claim 12, wherein the actuation means is remotely operable.

14. An apparatus as claimed in claim 1, wherein the actuation means is remotely operable.

15. An apparatus as claimed in claim 1, wherein the openings defined by the support members are formed for receiving beams having a cross-sectional shape chosen from a group consisting of cylindrical and non-cylindrical shapes.

16. An apparatus as claimed in claim 1, wherein the apparatus further includes quenching means.

17. An apparatus as claimed in claim 16, wherein the quenching means is provided by a water dispenser.

18. An apparatus as claimed in claim 16, wherein the quenching means is a chamber enclosing at least the beam and means for dispensing gas into the chamber to quench the beam.

19. An apparatus as claimed in claim 1, further comprising mounting means for mounting the apparatus on a production facility.

20. An apparatus as claimed in claim 1, wherein the actuation means is remotely operable in response to a control program running on a control unit.

21. An apparatus as claimed in claim 20, wherein the control program contains information regarding relative locations of the beam and each support member and a desired form of the beam at each point of contact with each support member.

* * * * *